United States Patent [19]

Beyer et al.

[11] Patent Number: 4,536,224

[45] Date of Patent: Aug. 20, 1985

[54] SALT BATH FOR THE CURRENTLESS PRODUCTION OF WEAR RESISTANT BORIDE LAYERS

[75] Inventors: Hans-Hermann Beyer, Kahl; Ulrich Baudis, Hanau; Peter Biberbach, Rodenbach; Wolfgang Weber, Karlstein, all of Fed. Rep. of Germany

[73] Assignee: Degussa Aktiengesellschaft, Frankfurt, Fed. Rep. of Germany

[21] Appl. No.: 630,302

[22] Filed: Jul. 12, 1984

[30] Foreign Application Priority Data

Jul. 26, 1983 [DE] Fed. Rep. of Germany ..... 3326863

[51] Int. Cl.[3] ..... C23C 9/40

[52] U.S. Cl. ..... 148/6.11; 148/15.5

[58] Field of Search ..... 148/6 B, 6.11, 15.5; 427/431

[56] References Cited

U.S. PATENT DOCUMENTS

| | | | |
|---|---|---|---|
| 3,634,145 | 1/1972 | Homan | 148/6.11 |
| 3,936,327 | 2/1976 | Fichtl | 148/15.5 |

FOREIGN PATENT DOCUMENTS

| | | | |
|---|---|---|---|
| 959533 | 6/1964 | United Kingdom . | |
| 535374 | 1/1977 | U.S.S.R. | 148/6.11 |
| 0676639 | 7/1979 | U.S.S.R. | 148/6.11 |

OTHER PUBLICATIONS

Thin Solid Films, 78, (1981), pp. 67–76.

*Primary Examiner*—Sam Silverberg

*Attorney, Agent, or Firm*—Cushman, Darby & Cushman

[57] ABSTRACT

There is described a salt bath based on an alkali and/or alkaline earth metal halide with which there can be produced without the use of current adherent and wear resistant boride coatings on metallic workpieces. This bath contains gaseous boron monofluoride or a compound from which there is formed intermediately boron monofluoride. Advantageous there is used a salt bath containing 30–60% $BaCl_2$, 10–25% NaCl, 1–20% boron oxide or borate, 10–30% NaF, and 1–15% $B_4C$.

17 Claims, No Drawings

SALT BATH FOR THE CURRENTLESS PRODUCTION OF WEAR RESISTANT BORIDE LAYERS

BACKGROUND OF THE INVENTION

The invention is directed to a salt bath based on an alkali and/or alkaline earth metal halide for the currentless production of wear resistant boride coatings on metallic workpieces at 650° to 1100° C. It is especially useful in the production of single phase, hard and adherent boride layers on steel to increase the wear resistance and to improve the corrosion resistance.

It has long been known to protect steel and refractory metals from wear by boriding through diffusion of the element boron into the surface of the treated workpiece and reaction with the base material there are formed dense, homogeneous layers of the respective borides, on iron, e.g. the boride FeB and $Fe_2B$. The borides have considerably different properties compared to the pure metals. In particular most borides are also very hard, corrosion resistant, and therewith are extremely wear resistant. The boride layers are firmly bound with the base work material through diffusion. In regard to their wear resistance, e.g. borided steels are in part superior to steels treated by nitriding or carburizing.

Therefore in the past there were developed a large number of industrial process variants according to which there can be produced boride layers, especially on steel.

In practice there was used almost exclusively boriding in solid boriding agents. Thereby the parts to be treated in iron tanks were packed in a boron supplying powder, usually mixtures of boron carbide, aluminum oxide, silicon oxide, and the like with activating additives such as ammonium fluoride or potassium borofluoride (e.g. German Pat. No. 1,796,216). The tanks were closed tightly and annealed for some time whereby the desired boride layers were built in direct solid body-solid reactions or by transport of the boron via the gas phase. This powder has a number of disadvantages.

Thus all parts must be carefully placed by hand in the powder. Furthermore, in the annealing the powder sinters strongly together so that the borided parts are very hard to take out and additionally must be subsequently purified. At the same time large amounts of boriding powder are needed which make the process extraordinarily expensive. Finally in boriding in powders many non-uniform layers must be dealt with. Quality control is not possible through judging a single part since this is not representative of the charge, since the quality of the parts depends essentially on the carefulness in placing them in the boriding powder. Small parts, parts with thin bore holes, undercuts etc., generally either cannot be borided in the powder or can only be borided with extreme expense.

Therefore, there have been numerous attempts to compensate for the disadvantages through other processes. Thus it was tried to put the boriding powder in the form of a suspension or paste on the part, evaporate the solvent and to anneal the part in the crust of boriding residues which arose, (e.g. H. Kunst. O. Schaaber, Hartereitechn. Mitt. 22 (1967), 275–284).

However, these methods which are known as paste processes are only modifications of powder boriding and have the additional disadvantage that after the treatment large amounts of persistent residues must be loosened from the parts and that it is extremely difficult to uniformly apply the paste, particularly with complicatedly shaped parts.

Likewise, it is difficult to avoid the formation of bubbles in the paste coat or the crumbling away of the crust in the annealing.

Therefore it was also tried to boride in gaseous medium, for example with a boron halide/hydrogen mixture (EPO published application No. 76488). Indeed there were obtained boride coatings. However, these are either unusable industrially or are only producible in very expensive ways. In boriding with boron halides there always occurs an uncontrollable corrosion of the base work material since the latter reacts with the boron halide with formation of metal halide and boride. Consequently there are formed porous, undercut boride coatings. Boriding with diborane is nearly impossible industrially on account of the extreme explosibility and high toxicity of this gas. Besides boriding with the mentioned gaseous media is also uneconomical because of the high price of the boron compounds. For these reasons there have been attempts to avoid the mentioned disadvantages by boriding in liquid media, especially in molten salts. Thus there have been described melts based on alkali and alkaline earth chlorides with $B_2O_3$, borax or $KBF_4$. However, in such melts a work material can only be borided if simultaneously there is carried out an electrolysis. Thereby the workpiece to be borided is connected cathodically, the crucible or a graphite rod serves as the anode. This process has the disadvantage that different current densities produce non-homogeneous coating thicknesses on complicated parts. Besides oxygen, chlorine or fluorine is formed at the anode as a result of which there is produced severe corrosion. Furthermore, there is difficulty in charging since an electrical contacting of the individual parts is required. For these reasons the electrolytic boriding processes in salt melts have not been introduced into the art.

In contrast only very little is known about boriding in salt melts without electrolysis. There is described in Hartereitechn, Mitt 17 [1962], 131–140 a melt made of 80% NaCl, 15% $NaBF_4$ and 5% $B_4C$, in which case, however, there is simultaneously made reference to the fact that $NaBF_4$ dissolved in the melt very quickly decomposes to NaF and $BF_3$, which escapes. Through this instability of the melt there cannot be obtained a periodically constant boriding action. The melt is very quickly inactivated. German OS 3118585 recites a process for boriding in salt melts without electrolysis in which the boron necessary for the boriding is set free by reaction of borax with silicon carbide. Because of the oxidation of SiC to $SiO_2$ by oxygen of the air or through decomposition of SiC with borate, however, there is very shortly formed in such melts an impervious silicate coating on the surface of the bath.

Furthermore, there are known currentless boriding salt baths which contain, in addition to boron carbide, boric acid and fluoroborate (Great Britain Pat. No. 959533) or an alkali or alkaline earth metal halide and fluoroborate (Homan U.S. Pat. No. 3,634,145). Yet these salt baths also have not been able to be put into practice.

Therefore it was the problem of the present invention to develop a salt based on alkali and/or alkaline earth metal halides for the currentless production of wear resistant boride coatings on metallic work materials at temperatures of 650° to 1100° C. which is simple and economical to operate, forms no crusts on the bath surface and furnishes adhering boride coatings, which especially with steels consist of (or consist essentially of), single phase $Fe_2B$ coatings.

SUMMARY OF THE INVENTION

This problem was solved according to the invention by including in the salt bath boron monofluoride or compounds which under the conditions of the bath form boron monofluoride as an intermediate.

As alkali and alkaline earth metal halide there can be employed for example sodium chloride, sodium fluoride, sodium bromide, potassium chloride, potassium fluoride, potassium bromide, calcium chloride, calcium fluoride, barium chloride or barium fluoride.

The boron monofluoride acting as boriding agent can be added to the melt from the outside or more advantageously is produced in the melt itself. In the first case gaseous boron monofluoride produced in known manner by heating boron trifluoride with finely divided boron is led into the salt melt during the boriding process.

There is obtained an especially simple to operate boriding bath if the boron monofluoride is produced in the salt melt itself. Surprisingly it was found that boriding can be carried out in an inert, good water soluble and low viscosity melt of alkali and alkaline earth chlorides if there is suspended therein a boriding agent as for example boron carbide powder activated by trifluoroboroxole and which gives rise to the giving off of boron monofluoride which in turn decomposes on the surface of the structured part and in this manner transfers the boron from the boron carbide to the workpiece.

The required trifluoroboroxole $(BOF)_3$ is likewise produced in the melt itself. This is based on the knowledge that $(BOF)_3$ can be produced very readily by reaction of boron oxide or borates, (e.g. alkali or alkaline earth metal borates, e.g. sodium metaborate, borax, potassium tetraborate, calcium borate, barium borate), with alkali/alkaline earth metal fluorides (e.g. sodium fluoride, potassium fluoride, calcium fluoride, barium fluoride) in an inert melt made of alkali/alkaline earth metal chlorides (sodium chloride, potassium chloride, calcium chloride, barium chloride), in which case particularly the presence of barium ions exerts a positive influence. The trifluoroboroxol formed in this manner in scarcely measurable concentration reacts with the boron carbide suspended in the melt to form the true boriding agent, boron monofluoride BF.

Therefore, there are preferably used salt melts which in addition to the alkali and/or alkaline earth halide contain 1 to 30 weight % of a boron-oxygen compound, 1 to 30 weight % of an alkali and/or alkaline earth metal fluoride, 1 to 15 weight % of boron carbide and barium ions from 30 to 60 weight % of barium chloride.

The trifluoroboroxole formed by reaction of boron-oxygen compounds with fluorides causes a slow, controlled decomposition of the boron carbide whereby boridingly active boron monofluoride is set free, which through decomposition can give up boron to the workpiece surface. In place of boron carbide there can also be used other known boriding agents such as calcium boride.

The boriding action of the melt can be influenced above all by variations in the concentration of boron oxide ($B_2O_3$) or borate and of the alkali/alkaline earth fluoride as well through changes of the temperature, and to a small degree, through change of the concentration of the boron carbide. Thus it has been shown that it is possible with the salt melt according to the invention to produce coatings of $Fe_2B$ on steel in which coatings there does not occur any undesired boron rich phase FeB.

Preferably there are used salt melts which consist of 30–60 wt. % $BaCl_2$, 10–20 wt. % $B_2O_3$, alkali and/or alkaline earth metal borates, 10–30 wt. % NaF, 10–25 wt. % NaCl and 1–15 wt. % $B_4C$. Salt baths having the composition 40–55 wt. % $BaCl_2$, 5–15 wt. % $B_2O_3$, alkali and/or alkaline earth metal borate, 18–25 wt. % NaF, 15–20 wt. % NaCl and 4–10 wt. % $B_4C$ are particularly advantageous.

In practice the salt melts of the invention make possible an extremely simple operation. The salt mixture is melted in a melting crucible made of heat resistance steel and the $B_4C$ held in suspension through the introduction of an inert gas, e.g. nitrogen. The workpieces to be borided are secured on a charge rack, e.g. preheated with hot air to 350° C. and then hung in the melt. With steels there are produced homogeneous, very wear resistant, single phase coatings made of $Fe_2B$, whereby the thickness of the coating can be varied according to the base material and time of treatment. The parts are withdrawn from the melt and quenched at about 200° C., e.g. in a quenching bath made of sodium and potassium nitrate which is customary in the hardening art and then the parts are rinsed with water. In this way no fluoride goes into the sewage.

The process of the invention consequently can be integrated without problem into the existing infrastructure of a heat treatment plant without the need of a mentionable investment or an additional treatment of the sewage.

The method of operation corresponds substantially to that of salt bath carburizing or salt bath nitriding. The melts are composed of relatively cheap components. Therewith a boriding process is present which in regard to the method of operation and costs can compete with the known large scale industrial processes of salt bath nitriding and salt bath carburizing.

Unless otherwise indicated all parts and percentages are by weight.

The composition can comprise, consist essentially of, or consist of the stated materials.

The following examples give salt bath compositions for carrying out the boriding.

DETAILED DESCRIPTION

EXAMPLE 1

There were melted in a crucible furnace having the size 30/80 100 kg of a salt mixture made of 50 kg $BaCl_2$, 15 kg NaF, 20 kg NaCl, 5 kg $B_2O_3$ and 10 kg $B_4C$ powder and the boron carbide was suspended by conveying an inert gas stream through the melt. At a treatment temperature of 900° C. and a treatment time of 2 hours there was obtained on CK 15 steel a boride coating of $Fe_2B$ having a thickness of 60 μm and free from FeB.

EXAMPLE 2

There were melted in a crucible furnace having the size of 30/80 100 kg of a salt mixture made of 50 kg $BaCl_2$, 25 kg KF, 15 kg NaCl, 5 kg $B_2O_3$ and 5 kg $B_4C$ and the boron carbide held in suspension by conveying an inert gas stream, e.g. nitrogen, through the melt. At a treatment temperature of 850° C. and a boriding time of 2 hours there was obtained on CK 15 steel a boride layer having a thickness of 30 μm and free from FeB.

EXAMPLE 3

Especial good boride coatings are supplied by salt melts of the following composition: 50 kg $BaCl_2$, 16 kg NaCl, 10 kg $B_2O_3$, 18 kg NaF, and 6 kg $B_4C$.

What is claimed is:

1. A salt bath containing alkali metal halide, alkaline earth metal halide or a mixture of alkali metal and alkaline earth metal halide and suitable for the currentless production of a wear resistant boride coating of $Fe_2B$ on metallic workpieces, said bath also containing boron monofluoride in a gaseous state or a compound which under the conditions of the operation of the bath forms boron monofluoride intermediately by a reaction of $(BOF)_3$ with a boriding agent.

2. A salt bath according to claim 1 containing 1 to 30 weight % of a boron-oxygen compound, 1 to 30 weight % of alkali metal fluoride, alkaline earth metal fluoride or a mixture of alkaline metal and alkaline earth fluoride, 1 to 15 weight % of boron carbide, and barium ions from 30 to 60 weight % of barium chloride.

3. A salt bath according to claim 1 consisting essentially of 30 to 60 weight % barium chloride, 10 to 25 weight % sodium chloride, 1 to 20 weight % of (a) boron oxide, (b) alkali metal borate, (c) alkaline earth metal borate, or (d) a mixture of at least two of (a), (b) and (c), 10 to 30 weight % sodium fluoride an 1 to 15 weight % boron carbide.

4. A salt bath according to claim 3 consisting essentially of 40 to 55 weight % barium chloride, 15 to 20 weight % sodium chloride, 5 to 15 weight % of (a) boron oxide, (b) alkali metal borate, (c) alkaline earth metal borate, or (d) a mixture of at least two of (a), (b), and (c), 18 to 25 weight % sodium fluoride and 8 to 10 weight % boron carbide.

5. A process of boriding a metal object comprising boriding it in the salt bath of claim 1 at boriding temperatures.

6. A process according to claim 5 wherein the metal is steel.

7. A process according to claim 6 wherein the temperature is 650° to 1100° C.

8. A process according to claim 7 including the step of generating the boron monofluoride in situ in the bath.

9. A process of boriding a metal object comprising boriding it in the salt bath of claim 2 at boriding temperature.

10. A process according to claim 9 wherein the metal is steel.

11. A process of boriding a metal object comprising boriding it in the salt bath of claim 3 at boriding temperature.

12. A process according to claim 11 wherein the metal is steel.

13. A process of boriding a metal object comprising boriding it in the salt bath of claim 4 at boriding temperature.

14. A process according to claim 13 wherein the metal is steel.

15. A salt bath according to claim 1 including boron carbide.

16. A process of bonding a metal object comprising bonding it in the salt bath of claim 15.

17. A process according to claim 16 wherein the metal is steel.

* * * * *